US008552972B2

(12) United States Patent
Kurita

(10) Patent No.: US 8,552,972 B2
(45) Date of Patent: Oct. 8, 2013

(54) BACKLIGHT APPARATUS, CONTROL METHOD FOR CONTROLLING THE SAME, AND IMAGE DISPLAY APPARATUS

(75) Inventor: Masanao Kurita, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/359,990

(22) Filed: Jan. 27, 2012

(65) Prior Publication Data

US 2012/0200800 A1 Aug. 9, 2012

(30) Foreign Application Priority Data

Feb. 8, 2011 (JP) ..... 2011-024895
Dec. 13, 2011 (JP) ..... 2011-272655

(51) Int. Cl.
*G09G 3/36* (2006.01)

(52) U.S. Cl.
USPC ..... 345/102; 349/61

(58) Field of Classification Search
USPC ..... 345/102; 349/61; 315/151
See application file for complete search history.

(56) References Cited

U.S. PATENT DOCUMENTS 7,067,995 B2 * 6/2006 Gunter et al. ..... 315/312
7,795,821 B2 * 9/2010 Jun ..... 315/308
2008/0088554 A1 * 4/2008 Lee ..... 345/87
2008/0129680 A1 * 6/2008 Kimura et al. ..... 345/102
2009/0021471 A1 * 1/2009 Park et al. ..... 345/102
2009/0278789 A1 * 11/2009 Declercq et al. ..... 345/102
2010/0128051 A1 * 5/2010 Mizuta et al. ..... 345/589

FOREIGN PATENT DOCUMENTS

JP 2001-142409 5/2001
JP 2008-159550 7/2008

* cited by examiner

*Primary Examiner* — Amare Mengistu
*Assistant Examiner* — Gloryvid Figueroa-Gibson
(74) *Attorney, Agent, or Firm* — Cowan, Liebowitz & Latman, P.C.

(57) ABSTRACT

A backlight apparatus comprises a light emission control unit which controls light emission of each of a plurality of light source blocks; a luminance detecting unit which detects a luminance of the light source block; and a correcting unit which successively executes a correcting process for the plurality of light source blocks by allowing one light source block to emit light so that a light emission amount of the concerning light source block is corrected on the basis of a detected luminance value and a target value thereof; wherein a temperature fluctuation suppressing process is executed when the correcting unit executes the correcting process, so that a plurality of the light source blocks, which include the light source block assumed to emit light in the correcting process to be executed next time, are simultaneously allowed to emit light for a predetermined period at a predetermined luminance.

29 Claims, 10 Drawing Sheets

BACKLIGHT APPARATUS, CONTROL METHOD FOR CONTROLLING THE SAME, AND IMAGE DISPLAY APPARATUS

BACKGROUND OF THE INVENTION

1. Field of the Invention

The present invention relates to a backlight apparatus, a control method for controlling the same, and an image display apparatus.

2. Description of the Related Art

An image display apparatus is generally constructed such that a backlight apparatus, which emits or radiates the white light, is combined on a back surface of a color liquid crystal panel which has a color filter. As for the light source of the backlight apparatus, a fluorescent lamp such as a cold cathode fluorescent lamp (CCFL) or the like has been in the mainstream. In recent years, an LED backlight apparatus, which uses, as a light source, a light emitting diode (LED) that is superior in view of the electric power consumption, the service life, the color reproducibility, and the environmental load, is also progressively used.

Japanese Patent Application Laid-open No. 2001-142409 describes an image display apparatus wherein an area of an LED backlight apparatus, which corresponds to a display area of a liquid crystal panel, is divided into a plurality of blocks (hereinafter referred to as "LED blocks"), LED is provided for each of the LED blocks, and the luminance of LED of each of the LED blocks can be controlled independently. The luminance is lowered for the LED block for radiating the light onto the area which displays a dark screen image and which is included in the display area of the color liquid crystal panel. Thus, the electric power consumption is reduced, and the contrast of a displayed image is improved. The luminance control for LED, which is performed for each of the LED blocks corresponding to the content (brightness) of the displayed image as described above, is referred to as "local dimming control".

Japanese Patent Application Laid-open No. 2008-159550 relates to a direct type backlight apparatus having LED's arranged for a plurality of partitioned LED blocks respectively, which discloses a method for measuring the luminance of each of the LED blocks by guiding the light of LED of each of the LED blocks to an external measuring apparatus by means of, for example, an optical fiber to perform the measurement.

SUMMARY OF THE INVENTION

When the luminance control is performed for each of the LED blocks in accordance with the local dimming control, a problem arises in relation to the uneven luminance caused by the dispersion of the secular change for each of the LED blocks. When the LED blocks are successively turned ON (subjected to the lighting) in a time sharing manner, and the luminance is detected by using an optical sensor (photo sensor), then the luminance of each of the LED blocks can be accurately measured without being affected by the light coming from the other LED blocks. Further, it is considered that the luminance dispersion can be corrected for each of the LED blocks and the uneven luminance can be suppressed by correcting the luminance of LED for each of the LED blocks on the basis of the measurement result. The process, in which the fluctuation of the luminance caused by the secular change of LED in relation to each of the LED blocks is corrected as described above, is herein referred to as "LED deterioration correcting process".

The structure of the LED backlight, in which LED's are arranged on the entire back surface of the liquid crystal panel without using any optical guide plate, is referred to as "direct type". The number of LED blocks of the direct type LED backlight apparatus is as much as several hundreds. If the LED deterioration correcting process is executed one by one for all of the hundreds of LED blocks, a long period of time (for example, about several minutes) is required until the LED deterioration correcting process is completed for all of the LED blocks. In view of the above, it is conceived that the LED deterioration correcting process is automatically carried out in the background in the spare time or free time after a user has used the image display apparatus.

When the LED deterioration correcting process is performed for all of the LED blocks by successively turning ON the plurality of LED blocks one by one in a time sharing manner, the influence, which is exerted on the temperature of the backlight apparatus by the heat generated by LED's, is decreased, because the number of LED blocks subjected to the lighting is small. A long period of time is required until the LED deterioration correcting process is completed for all of the LED blocks. Therefore, there is such a possibility that the temperature of the backlight apparatus may be fluctuated (lowered) during the period in which the LED deterioration correcting process is executed.

The light emission efficiency of LED has the temperature dependency. Therefore, if the temperature of the backlight apparatus is fluctuated during the period of execution of the LED deterioration correcting process, there is such a possibility that the light emission characteristic of LED may be dispersed in relation to each of the LED blocks. If such a situation arises, there is such a possibility that the uneven luminance cannot be suppressed sufficiently, even when the LED deterioration correcting process is performed for all of the LED blocks.

In view of the above, the present invention provides a backlight apparatus, a control method for controlling the same, and an image display apparatus which make it possible to suppress the temperature fluctuation during a period in which the LED deterioration correcting process is executed.

A first aspect of the present invention resides in a backlight apparatus having a plurality of light source blocks, the backlight apparatus comprising:

a light emission control unit which controls light emission of each of the plurality of light source blocks;

a luminance detecting unit which detects a luminance of the light source block;

a correcting unit which successively executes a correcting process for the plurality of light source blocks by allowing one light source block of the plurality of light source blocks to emit light so that a light emission amount of the concerning light source block is corrected on the basis of a luminance value detected by the luminance detecting unit and a target value thereof; and a temperature fluctuation suppressing unit which executes a temperature fluctuation suppressing process when the correcting unit executes the correcting process for one of the light source blocks or a plurality of the light source blocks, so that a plurality of the light source blocks, which include the light source block assumed to emit light in the correcting process to be executed next time, are allowed to emit light for a predetermined period at a predetermined luminance.

A second aspect of the present invention resides in a control method for controlling a backlight apparatus having a plurality of light source blocks, the control method comprising:

a light emission control step of controlling light emission of each of the plurality of light source blocks;

a luminance detecting step of detecting a luminance of the light source block;

a correcting step of successively executing a correcting process for the plurality of light source blocks by allowing one light source block of the plurality of light source blocks to emit light so that a light emission amount of the concerning light source block is corrected on the basis of a luminance value detected in the luminance detecting step and a target value thereof; and a temperature fluctuation suppressing step of executing a temperature fluctuation suppressing process when the correcting process is executed in the correcting step for one of the light source blocks or a plurality of the light source blocks, so that a plurality of the light source blocks, which include the light source block assumed to emit light in the correcting process to be executed next time, are allowed to emit light for a predetermined period at a predetermined luminance.

According to the present invention, it is possible to provide the backlight apparatus, the control method for controlling the same, and the image display apparatus which make it possible to suppress the temperature fluctuation during the period in which the LED deterioration correcting process is executed.

Further features of the present invention will become apparent from the following description of exemplary embodiments with reference to the attached drawings.

DESCRIPTION OF THE EMBODIMENTS

First Embodiment

Figure 1:
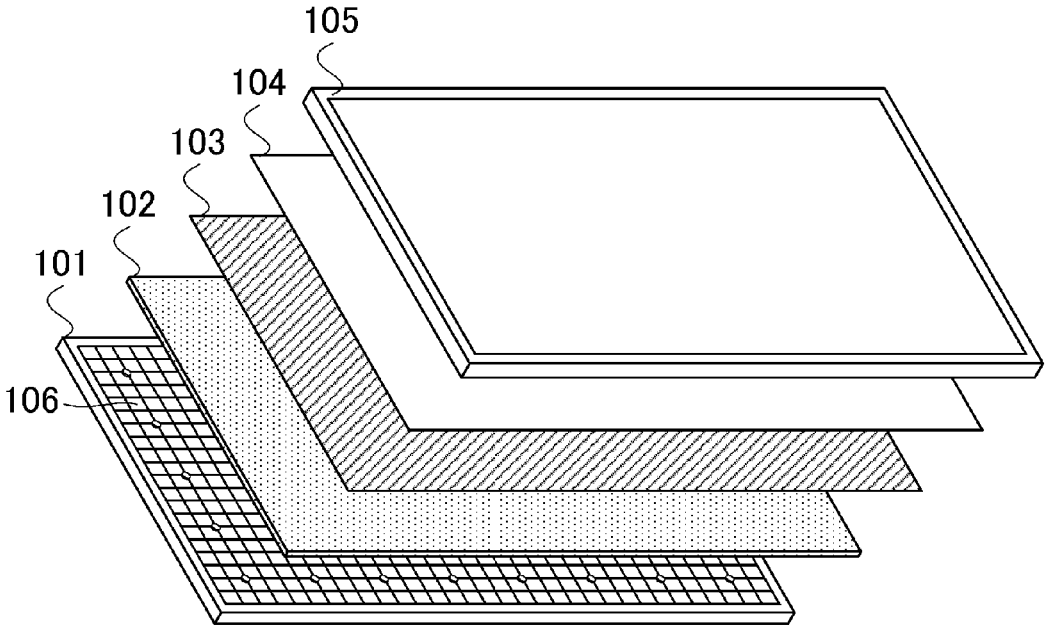
FIG. 1 shows constitutive parts of an image display apparatus according to an embodiment.

FIG. 1 shows constitutive parts of an image display apparatus to which the present invention is applicable. A direct(-underneath) type LED backlight module 101 is used as a backlight for radiating the white light onto a back surface of a color liquid crystal panel 105. The direct type LED backlight module 101 is divided into 640 LED blocks 106 (light source blocks) in total in which 20 LED blocks 106 are provided in the vertical direction and 32 LED blocks 106 are provided in the lateral direction. The luminance can be controlled independently from each other for each of the LED blocks (in the unit of light source block).

The larger the number of divided LED blocks 106 is, the more improved the accuracy of division of the display area in the local dimming control is. One LED block is an assembly of one LED (light source) or a plurality of LED's (light sources) for performing the light emission for one of the plurality of divided areas obtained by dividing the light emitting surface of the direct type LED backlight module 101.

A large number of LED's which are the point light sources are collected in the direct type LED backlight module 101. However, the white light, which is allowed to come from LED's, is sufficiently diffused by using a diffusion plate 102 to cause the surface light emission thereby so that the direct type LED backlight module 101 functions as a surface light source. The white light, which is diffused by the diffusion plate 102 and which is allowed to come at various angles of incidence, is collected in the front surface direction by a light-collecting sheet 103. Thus, the luminance is improved on the front surface.

A reflection type polarizing film 104 efficiently polarizes the incident white light to improve the luminance of the display displayed on the color liquid crystal panel 105 thereby. The color liquid crystal panel 105 performs the transmittance modulation for the radiated white light in relation to each of pixels of RGB, and thus a color screen image is displayed. The direct type LED backlight module 101, the diffusion plate 102, the light-collecting sheet 103, and the reflection type polarizing film 104 constitute the backlight apparatus.

In this embodiment, the direct type LED backlight module 101 is used. However, it is also possible to use an edge light type in which a plurality of LED's are arranged at frame portions and the light is delivered to the entire color liquid crystal panel 105 by means of an optical guide plate.

Figure 2A:
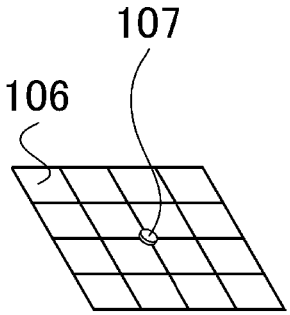
FIG. 2 schematically shows parts of a direct type LED backlight module in a magnified view.

FIG. 2A schematically shows apart of the direct type LED backlight module 101 in a magnified view. One optical sensor (photo sensor) 107 is provided for each group of the sixteen LED blocks 106 in total in which the four LED blocks 106 are provided vertically and the four LED blocks 106 are provided laterally. Only one LED block 106 is allowed to emit light (subjected to the light emission), and the white light, which is reflected by the diffusion plate 102, is subjected to the luminance detection by means of the optical sensor 107 corresponding to the group to which the concerning LED block 106 belongs. Thus, the luminance of the concerning LED block 106 is detected. The decrease in the luminance, which is caused by the secular change of LED, can be corrected for each of the LED blocks 106 on the basis of the luminance value of each of the LED blocks 106 detected as described above. Forty optical sensors 107 are provided in total for the entire direct type LED backlight module 101.

Figure 2B:
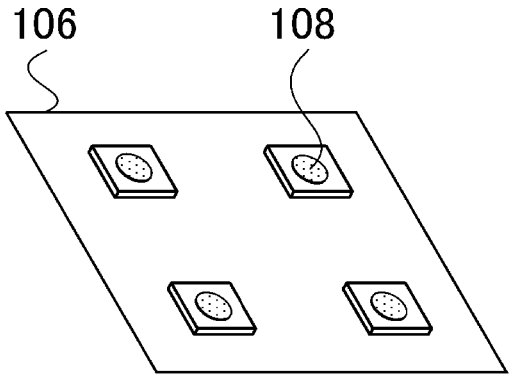

FIG. 2B schematically shows the LED block 106 in a magnified view. One LED block 106 is constructed by four white LED's 108 in total which are connected in series. The luminance can be controlled on the basis of the unit of the LED block in relation to the plurality of white LED's for constructing the direct type LED backlight module 101. It is also possible to provide such an arrangement that the white light is obtained by combining multicolor LED's including, for example, red LED's, green LED's, and blue LED's, in place of the white light LED 108.

Figure 2C:
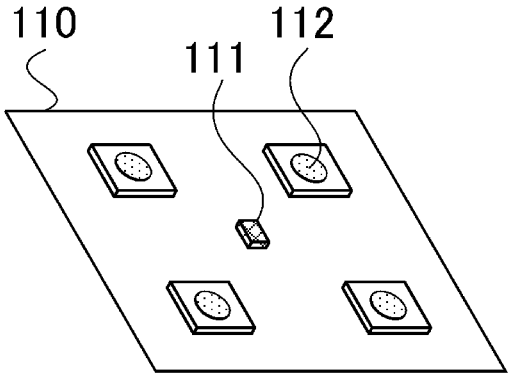

FIG. 2C schematically shows an LED block 110 on which a temperature sensor 111 (temperature detecting unit) is mounted. One LED block 110, on which the temperature sensor 111 is mounted, is arranged in the vicinity of the center of the direct type LED backlight module 101. A chip type thermistor is used for the temperature sensor 111. The temperature sensor 111 detects the temperature of the direct type LED backlight module 101. In this embodiment, the temperature of the LED block 110, which is detected by the temperature sensor 111, is designated as the temperature which represents the environmental temperature (ambient temperature) of LED of the LED block, which is referred to as "LED temperature" in the LED deterioration correcting process as described later on. However, one temperature sensor 111 may be provided for each group composed of a predetermined number of the LED blocks. In this case, a plurality of temperature sensors are arranged in the direct type LED backlight module 101. In the case of the arrangement in which the plurality of temperature sensors are provided, the environmental temperature of a certain LED block can be represented by the temperature detected by the temperature sensor corresponding to the group to which the concerning LED block belongs.

Figure 3:
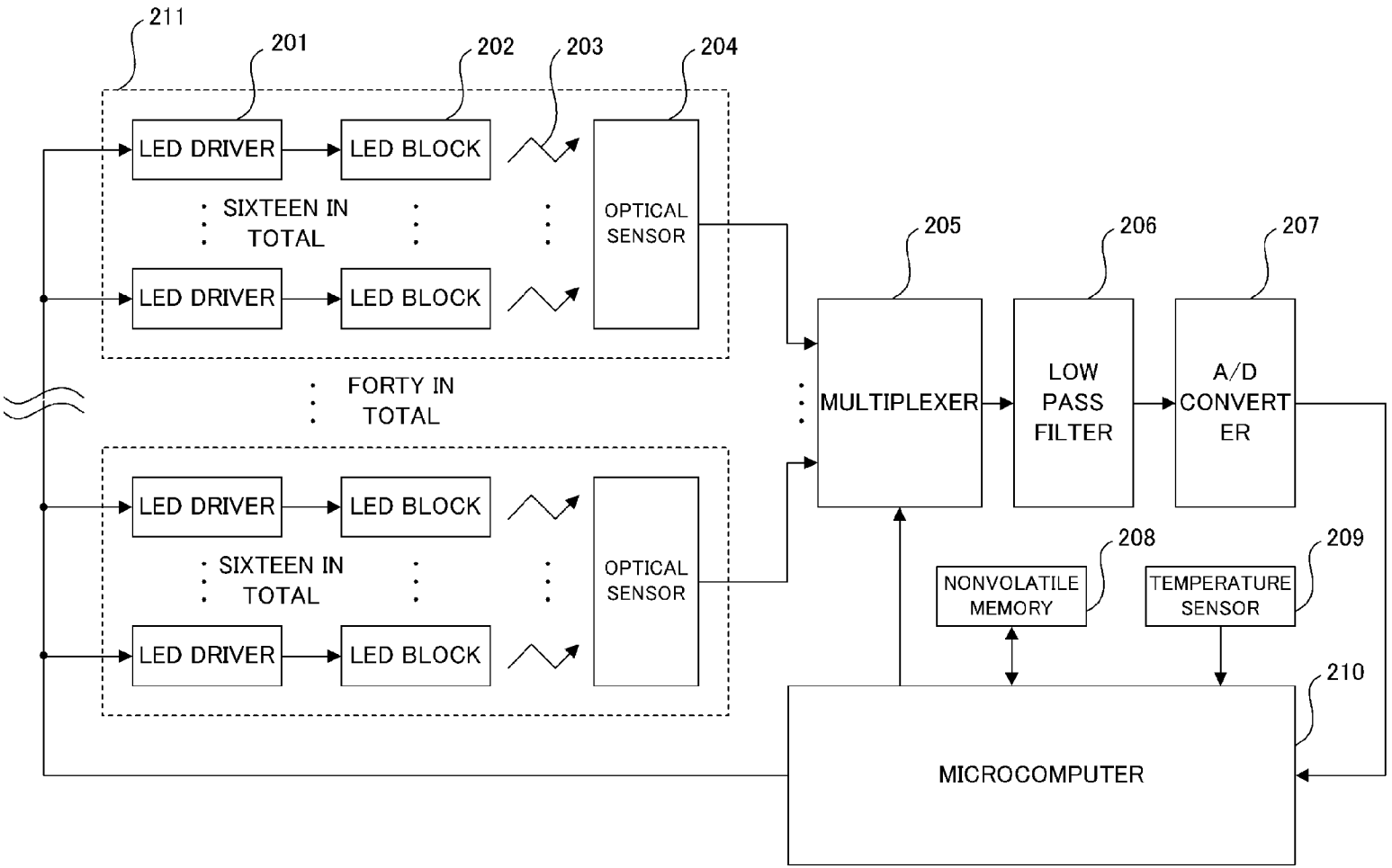
FIG. 3 shows a block diagram illustrating an arrangement of the direct type LED backlight module.

FIG. 3 shows a block diagram illustrating an arrangement of the direct type LED backlight module 101. The LED block 202 is subjected to the lighting (light emission) by means of an LED driver 201. The luminance can be adjusted independently for each of the LED blocks 202 in accordance with the current amount control and the PWM control. The current amount and the duty ratio based on PWM are changed on the basis of the control signal supplied from a microcomputer 210 (light emission control unit). The current amount and the duty ratio based on PWM correspond to the instruction value (or the light emission amount) provided when the light source control unit allows the light source of the light source block to emit the light.

One optical sensor (photo sensor) 204, which detects the luminance of the LED block belonging to the concerning group, is provided for one assembly 211 of the LED blocks in which four LED blocks are provided vertically and four LED blocks are provided laterally. A photodiode, which has the sensitivity to cover the light emission spectrum of the LED block 203, is used for the optical sensor 204. When only a certain LED block emits the light, the luminance of the concerning LED block can be calculated on the basis of the detected value obtained by the optical sensor 204 corresponding to the LED block assembly to which the concerning LED block belongs and the positional relationship between the concerning LED block and the optical sensor 204. The luminance of each of the LED blocks 202 can be detected by the optical sensor 204. Therefore, it is possible to correct the decrease in the luminance caused by the secular change of each of the LED blocks 202.

Forty of the LED block assemblies 211 are provided in total, in each of which four LED blocks are provided vertically and four LED blocks are provided laterally in relation to the entire direct type LED backlight module 101. Therefore, forty of the optical sensors 204 are also provided in total. The detected values, which are supplied from the forty optical sensors 204 in total, are inputted into a multiplexer 205 in order to switch the detected values. The switching control of the multiplexer 205 is performed by the microcomputer 210. Accordingly, a certain detected value supplied from a certain optical sensor 204 included in the forty optical sensors 204 can be selected to be outputted to the functional block disposed on the downstream stage.

The detected value, which is selected by the multiplexer 205, is inputted into a low pass filter 206. The LED block 202 is turned ON intermittently in accordance with the PWM control. Therefore, the detected value of the optical sensor 204 is also an intermittent output. The output of the detected value is integrated by the low pass filter 206, which is outputted as a smoothed detected value.

The detected value, which is integrated by the low pass filter 206, is inputted into an A/D converter 207. The A/D converter 207 performs the digital conversion for the inputted detected value. The detected value, which is subjected to the digital conversion, is inputted into the microcomputer 210.

A nonvolatile memory 208 is connected to the microcomputer 210. For example, a correction parameter, which is obtained as a result of the LED deterioration correcting process, is held in the nonvolatile memory 208. Further, a temperature sensor 209 is connected to the microcomputer 210. The temperature sensor 209 detects the temperature of LED during the period of the LED deterioration correcting process.

In the image display apparatus having the arrangement illustrated in the block diagram as described above, the microcomputer 210 performs the LED deterioration correcting process for the direct type LED backlight module 101. In the LED deterioration correcting process, the microcomputer 210 successively turns ON the 640 LED blocks 202 in total one by one in a time sharing manner. The reason, why only one LED block 202 is allowed to emit the light and a plurality of the LED blocks 202 are not turned ON simultaneously in this procedure, is as follows. That is, if a plurality of the LED blocks 202 are allowed to emit the light, the optical sensor detects the light of any LED block other than the LED block as the luminance detection objective. There is such a possibility that any error arises in the correction.

In the LED deterioration correcting process, the microcomputer 210 successively turns ON the LED blocks 202 in a time sharing manner by means of the LED drivers 201. The detected value outputted from the optical sensor 204 is selected by the multiplexer 205 corresponding to the LED block 202 subjected to the lighting. Accordingly, the detected value, which is integrated while passing through the low pass filter 206, is subjected to the digital conversion by the A/D converter 207. The detected value, which is subjected to the digital conversion, is inputted into the microcomputer 210. The microcomputer 210 updates the correction parameter for correcting the instruction value (for example, the current value and the PWM duty ratio) to be used when LED of the lighted LED block 202 is allowed to emit the light, on the basis of the comparison between the inputted detected value and the target detected value held in the nonvolatile memory 208. The instruction value, which is, for example, the current value and the PWM duty ratio to be used when LED is subjected to the light emission, is corrected, and thus the light emission amount of LED is corrected. The microcomputer 210 successively executes the LED deterioration correcting process as described above in the time sharing manner for all of the LED blocks 202. Accordingly, the decrease in the luminance, which is caused by the secular change of each of the LED blocks 202, is corrected, and it is possible to suppress the uneven luminance on the entire display screen of the image display apparatus.

The temperature sensor 209 detects the LED temperature during the period in which the LED blocks 202 are successively turned ON in the time sharing manner. The LED temperature is raided by the waste heat of LED during the ordinary operation in which the LED deterioration correcting process is not performed, because a large number of the LED blocks are turned ON even when the local dimming control is performed.

On the other hand, almost all of the waste heat from LED disappears during the period of execution of the LED deterioration correcting process, because the LED blocks 202 are successively turned ON one by one in the time sharing manner. The backlight apparatus, which has been warmed during the ordinary operation, progressively undergoes the decrease in temperature. If the LED temperature is fluctuated in the period of the LED deterioration correcting process, there is such a possibility that the light emission efficiency of LED may be changed, and the correction, which is to be performed by the LED deterioration correcting process, cannot be performed accurately. In view of the above, in this embodiment, a process, in which all of the LED blocks 202 are turned ON at the same time (subjected to the simultaneous lighting), is inserted into the progress of the LED deterioration correcting process period in which the LED blocks 202 are successively turned ON one by one. Accordingly, the waste heat of LED is temporarily increased, and the backlight apparatus is suppressed from the decrease in temperature. In this embodiment, the simultaneous lighting process for all of the LED blocks, which is inserted into the progress of the period of execution of the LED deterioration correcting process, is referred to as "LED temperature fluctuation suppressing process". In the LED temperature fluctuation suppressing process, it is not necessarily indispensable that all of the LED blocks should be turned ON at the same time. It is also allowable that some of the 640 LED blocks are turned ON, provided that the effect is obtained such that the temperature decrease of the backlight apparatus is suppressed and the ambient temperature of LED is suppressed from the fluctuation when the LED deterioration correcting process is executed for each of the LED blocks.

Figure 4:
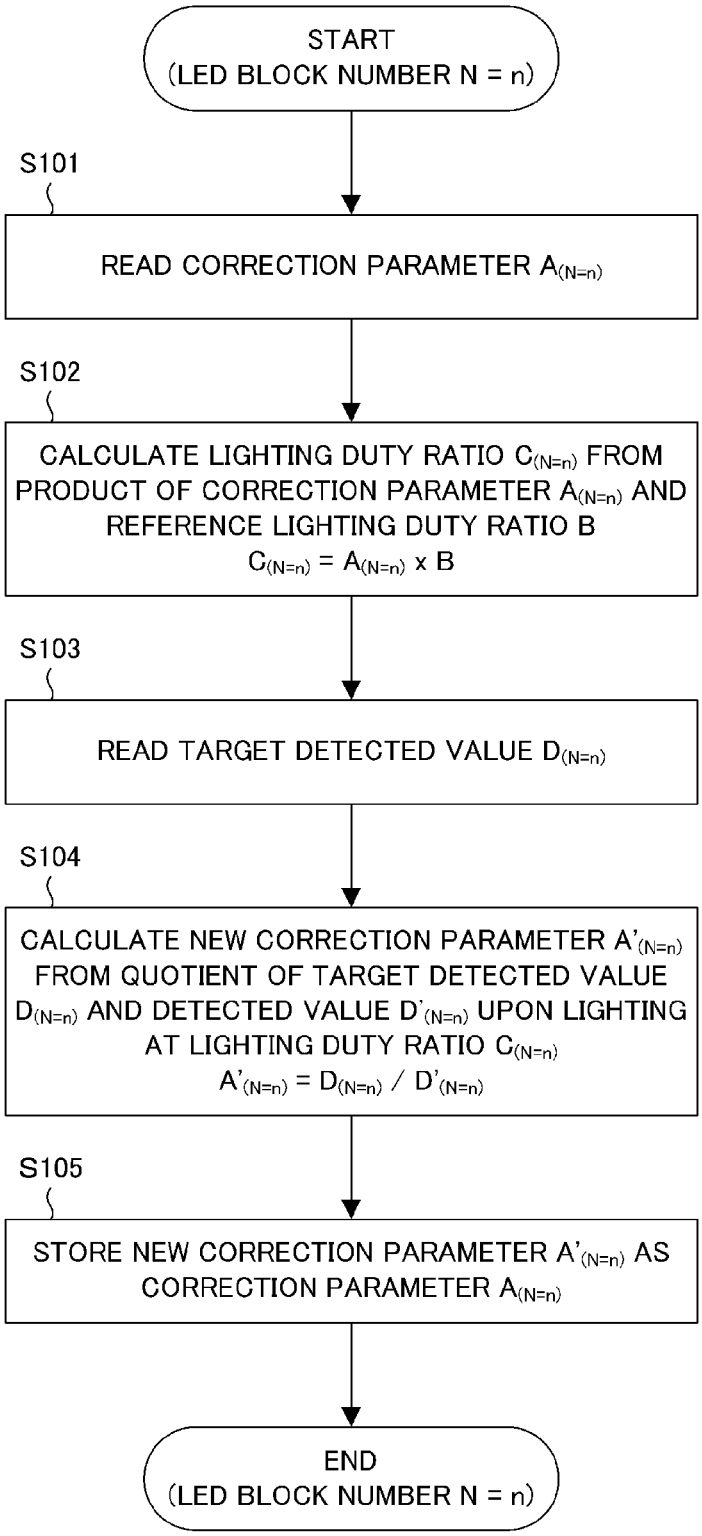
FIG. 4 shows a flow chart illustrating an LED deterioration correcting process for an LED block number N=n.

The LED block numbers N=n are allotted respectively to the 640 LED blocks 202 in total of the direct type LED backlight module 101. n is an integer from to 640. FIG. 4 shows a flow chart illustrating a procedure of the LED deterioration correcting process for the LED block having the LED block number N=n carried out by the microcomputer 210. The process, which is represented by the flow chart shown in FIG. 4, corresponds to the correcting process according to the present invention. The microcomputer 210, which executes the process represented by the flow chart shown in FIG. 4, functions as the correcting unit according to the present invention.

At first, in Step S101, the microcomputer 210 reads the correction parameter $A_{(N=n)}$ of the LED block number N=n held or stored in the nonvolatile memory 208.

Subsequently, in Step S102, the microcomputer 210 calculates the lighting duty ratio (turn-on duty ratio) $C_{(N=n)}$ of the LED block number N=n from the product of the correction parameter $A_{(N=n)}$ and the reference lighting duty ratio B determined uniformly for the entire direct type LED backlight module 101. For example, the microcomputer 210 calculates the lighting duty ratio $C_{(N=n)}$=62.298 percent from the product of the correction parameter $A_{(N=n)}$=1.031 and the reference lighting duty ratio B=60.425 percent.

The reference lighting duty ratio B represents the reference value of the lighting time ratio in the PWM control for LED, which determines the display luminance as the entire display screen. The correction parameter $A_{(N=n)}$ is updated by carrying out the LED deterioration correcting process. The larger the luminance deterioration of the LED block 202 is, the larger the updated value of the correction parameter is. Accordingly, the larger the luminance deterioration of the LED block 202 is, the larger the calculated lighting duty ratio $C_{(N=n)}$ is. As a result, the luminance of the LED block 202 is maintained to have the target value.

Subsequently, in Step S103, the microcomputer 210 reads the target detected value $D_{(N=n)}$ of the LED block number N=n stored in the nonvolatile memory 208. The target detected value $D_{(N=n)}$ is the detected value to be detected by the optical sensor 204 when only the LED block of the LED block number N=n is turned ON in a state in which the luminances of all of the LED blocks are adjusted so that the uneven luminance of the entire display screen is suppressed.

The state, in which the luminances of all of the LED blocks are adjusted so that the uneven luminance of the entire display screen is suppressed, is such a state that the luminances of the respective LED blocks are adjusted respectively so that the dispersion of the luminance among the LED blocks is not more than an allowable level. The target detected value $D_{(N=n)}$ corresponds to the target value of the luminance value of the light source block detected by the luminance detecting unit according to the present invention. The target detected value $D_{(N=n)}$ is determined upon the shipping adjustment in a factory. The target detected value $D_{(N=n)}$ is the value corresponding to the dispersion of the light-receiving sensitivity of the optical sensor 204 and the positional relationship between the LED block 202 and the optical sensor 204. In this embodiment, the optical sensor 204 is provided for each of the groups of the plurality of (sixteen) LED blocks. Therefore, the target detected value $D_{(N=n)}$ is determined depending on the positional relationship between the concerning LED block and the optical sensor corresponding to the group to which the LED block having the LED block number N=n belongs.

In Step S104, anew correction parameter $A'_{(N=N)}$ is calculated on the basis of the ratio between the target detected value $D_{(N=n)}$ and the detected value $D'_{(N=n)}$ obtained by the optical sensor 204 when the LED block of the LED block number N=n is turned ON at the lighting duty ratio $C_{(N=n)}$. For example, in the case of the target detected value $D_{(N=n)}$=1328 and the detected value $D'_{(N=n)}$=1242, the microcomputer 210 calculates a new correction parameter $A'_{(N=n)}$=1.069. The more lowered the luminance of LED of the LED block having the block number N=n due to the secular change is, the smaller the actual detected value $D'_{(N=n)}$ is as compared with the target detected value $D_{(N=n)}$. Therefore, a large value is calculated for the new correction parameter $A'_{(N=n)}$.

Subsequently, in Step S105, the microcomputer 210 updates the correction parameter $A_{(N=n)}$ held in the nonvolatile memory 208 by using the calculated new correction parameter $A'_{(N=n)}$. Thus, the flow is completed for the LED deterioration correcting process for the LED block of the LED block number N=n. The LED deterioration correcting process is successively executed for the LED blocks having the LED block numbers 1 to 640. However, in the case of the backlight apparatus of this embodiment, the LED temperature fluctuation suppressing process is inserted every time when one LED deterioration correcting process or a plurality of LED deterioration correcting processes is/are executed.

Figure 5:
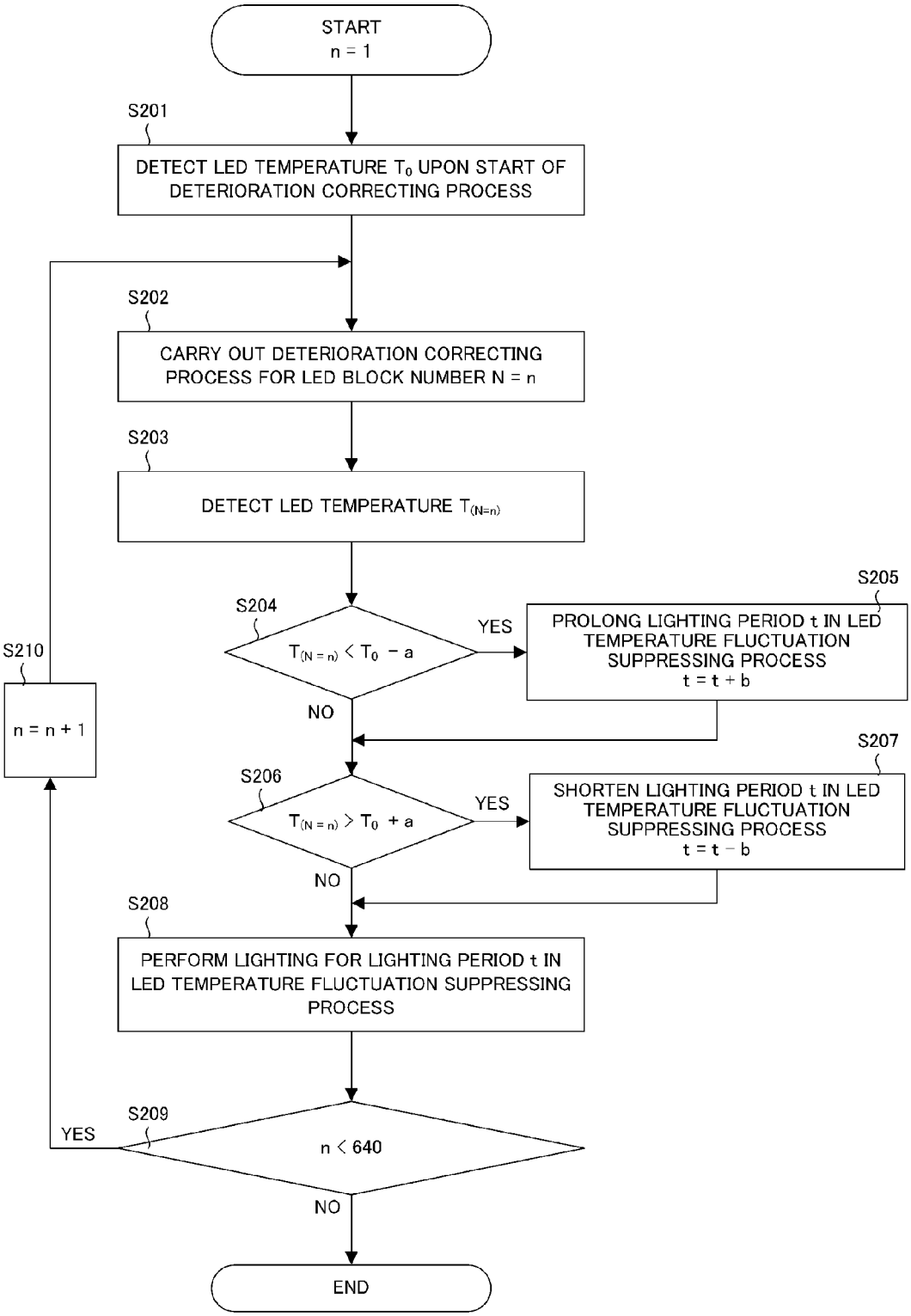
FIG. 5 shows a flow chart illustrating an LED deterioration correcting process into which an LED temperature fluctuation suppressing process is inserted.

FIG. 5 shows a flow chart illustrating a process in which the LED deterioration correcting process is successively executed for the 640 LED blocks 202 in total of the direct type LED backlight module 101 while inserting then LED temperature fluctuation suppressing process. The process, which is represented by the flow chart shown in FIG. 5, corresponds to the temperature fluctuation suppressing process according to the present invention. The microcomputer 210, which executes the process represented by the flow chart shown in FIG. 5, functions as the temperature fluctuation suppressing unit according to the present invention.

At first, in Step S201, the microcomputer 210 detects the LED temperature $T_0$ upon the start of the LED deterioration correcting process (LED temperature after the LED deterioration correcting process is firstly executed, initial temperature) by means of the temperature sensor 209. The microcomputer 210 performs the LED deterioration correcting process in the background in the spare time or free time after the user has used the image display apparatus. The backlight apparatus is warmed while being sufficiently subjected to the temperature aging, after the user has used the image display apparatus. Therefore, the LED deterioration correcting process can be executed in a situation in which the temperature of the backlight apparatus is stabilized. It is possible to perform the correction accurately.

In Step S202, the microcomputer 210 carries out the LED deterioration correcting process for the LED block having the LED block number N=n as illustrated in the flow chart shown in FIG. 4. Subsequently, in Step S203, the microcomputer 210 detects the LED temperature $T_{(N=n)}$ after carrying out the LED deterioration correcting process for the LED block of the LED block number N=n. Only the LED block of the LED block number N=n is turned ON in the period of the LED deterioration correcting process for the LED block number N=n. Therefore, the waste heat is decreased, and the LED temperature is lowered. When the temperature sensor is provided for each of the groups of the plurality of LED blocks, the LED temperature $T_{(N=n)}$ may be the detected value obtained by the temperature sensor corresponding to the group to which the LED block of the LED block number N=n belongs. That is, the LED temperature is detected by the temperature sensor corresponding to the group to which the LED block subjected to the correcting process executed just before belongs.

In Step S204, the microcomputer 210 judges whether or not the LED temperature $T_{(N=n)}$ is lower than the LED temperature $T_0$ upon the start of the LED deterioration correcting process by not less than a threshold value a ($T_{(N=n)}<T_0-a$). The threshold value a is determined on the basis of the LED temperature fluctuation width in the LED deterioration correcting process period such that the uneven luminance of the direct type LED backlight module, which is provided just after carrying out the LED deterioration correcting process for all of the LED blocks, is not more than a predetermined allowable level.

If the LED temperature $T_{(N=n)}$ is lower than the LED temperature $T_0$ upon the start of the LED deterioration correcting process by not less than the threshold value a, the microcomputer 210 prolongs or lengthens the lighting period t in the LED temperature fluctuation suppressing process by a lighting period adjustment width b in Step S205. The lighting period adjustment width b may be appropriately changed depending on the magnitude of the difference between the LED temperature $T_{(N=n)}$ and the LED temperature $T_0$ upon the start of the LED deterioration correcting process. The lighting period t corresponds to the predetermined period provided when the temperature fluctuation suppressing unit allows the plurality of light source blocks to emit the light in the temperature fluctuation suppressing process according to the present invention.

In Step S206, the microcomputer 210 judges whether or not the LED temperature $T_{(N=n)}$ is higher than the LED temperature $T_0$ upon the start of the LED deterioration correcting process by not less than the threshold value a ($T_{(N=n)}>T_0+a$). If the lighting period t is long in the LED temperature fluctuation suppressing process for the LED block number N=n−1, the LED temperature is unnecessarily raised in some cases. A situation is also assumed, in which the LED temperature is raised to a temperature higher than the temperature expected to be brought about by the LED temperature fluctuation suppressing process, on account of the increase in the environmental temperature.

If the LED temperature $T_{(N=n)}$ is higher than the LED temperature $T_0$ upon the start of the LED deterioration correcting process by not less than the threshold value, the microcomputer 210 shortens the lighting period t in the LED temperature fluctuation suppressing process by the lighting period adjustment width b in Step S207. In this procedure, the threshold value is the same threshold value a as that provided when the lighting period t is prolonged by the lighting period adjustment width b as described above. It is also allowable that the threshold value differs between the judgment to judge whether or not the lighting period t is prolonged and the judgment to judge whether or not the lighting period t is shortened.

In Step S208, the microcomputer 210 executes the LED temperature fluctuation suppressing process for the lighting period t. When the current amount in the LED temperature fluctuation suppressing process is made larger than the current amount during the ordinary lighting, it is possible to suppress the fluctuation (decrease) of the LED temperature by using the short lighting period t. The luminance of the LED block, which is provided when the lighting is effected with the current amount determined as described above, corresponds to the predetermined luminance provided when the temperature fluctuation suppressing unit allows the plurality of light source blocks to emit the light in the temperature fluctuation suppressing process according to the present invention. It is possible to regulate the effect to suppress the decrease in the LED temperature by appropriately adjusting the predetermined luminance and the predetermined period provided when the light source block is allowed to emit the light in the LED temperature fluctuation suppressing process.

If n<640 is given in Step S209, the LED deterioration correcting process is not completed for all of the LED blocks, and hence the microcomputer 210 rewrites the data to provide n=n+1 in Step S210 to proceed to the LED deterioration correcting process for the next LED block 202. If n=640 is given, the microcomputer 210 completes the LED deterioration correcting process for all of the LED blocks.

Figure 6A:
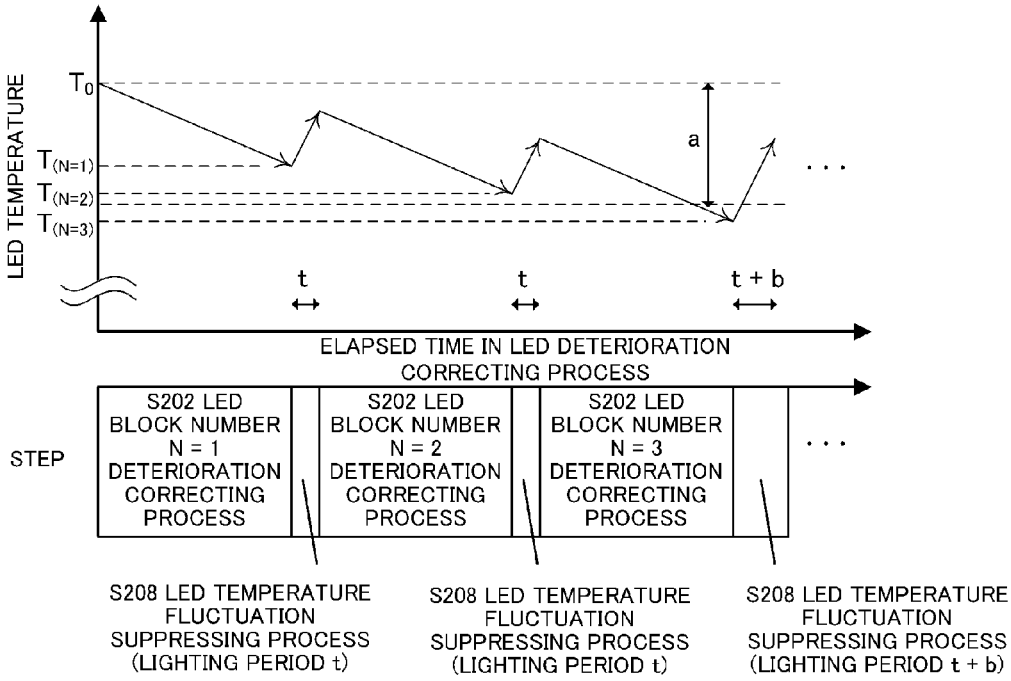
FIG. 6 shows exemplary relationships among the elapsed time in the LED deterioration correcting process, the step, and the LED temperature.

FIG. 6A shows an exemplary relationship among the elapsed time, the process step, and the LED temperature when the LED deterioration correcting process shown in the flow chart of FIG. 5 is carried out. The LED temperature $T_{(N=1)}$, which is obtained after the LED deterioration correcting process is performed in Step S202 for the LED block number N=1, is lowered from the LED temperature $T_0$ which is provided upon the start of the LED deterioration correcting process.

In this procedure, the LED temperature $T_{(N=1)}$ is not lowered by not less than the threshold value a as compared with the LED temperature $T_0$ upon the start of the LED deterioration correcting process. Therefore, the LED temperature fluctuation suppressing process is performed for a period of the lighting period t in Step S208. The LED temperature $T_{(N=2)}$, which is obtained after the LED deterioration correcting process is performed in Step S202 for the LED block number N=2, is not lowered by not less than the threshold value a as compared with the LED temperature $T_0$ upon the start of the LED deterioration correcting process. Therefore, the LED temperature fluctuation suppressing process is performed for a period of the lighting period t in Step S208.

The LED temperature $T_{(N=3)}$, which is obtained after the LED deterioration correcting process is performed in Step S202 for the LED block number N=3, is lower by not less than the threshold value a than the LED temperature $T_0$ upon the start of the LED deterioration correcting process. Therefore, the LED temperature fluctuation suppressing process is prolonged to t+b in Step S205, and the LED temperature fluctuation suppressing process is performed for a period of the lighting period t+b in Step S208. As a result of the LED temperature fluctuation suppressing process, as shown in FIG. 6A, the fluctuation of the LED temperature during the LED deterioration correcting process period is regulated to be included within the threshold value a as starting from the initial temperature $T_0$. Therefore, it is possible to suppress the decrease in the accuracy of the LED deterioration correcting process resulting from the temperature dependency of the LED light emission efficiency.

It is possible to arbitrarily set the size of the lighting period adjustment width b. For example, it is also allowable to use a value which is a half of the initial value t (t/2) or a value which is equal to the initial value t.

In the case of the process shown in FIG. 5, the LED temperature fluctuation suppressing process is inserted every time when the LED deterioration correcting process is executed for one LED block. However, the LED temperature fluctuation suppressing process may be inserted every time when the LED deterioration correcting process is executed for a plurality of the LED blocks.

That is, in the case of the process shown in FIG. 5, the LED temperature fluctuation suppressing process of Step S208 is executed every time when the LED block number N=n is increased by 1. However, the LED temperature fluctuation suppressing process of Step S208 may be executed every time when the LED block number N=n is increased by a predetermined number.

Figure 6B:
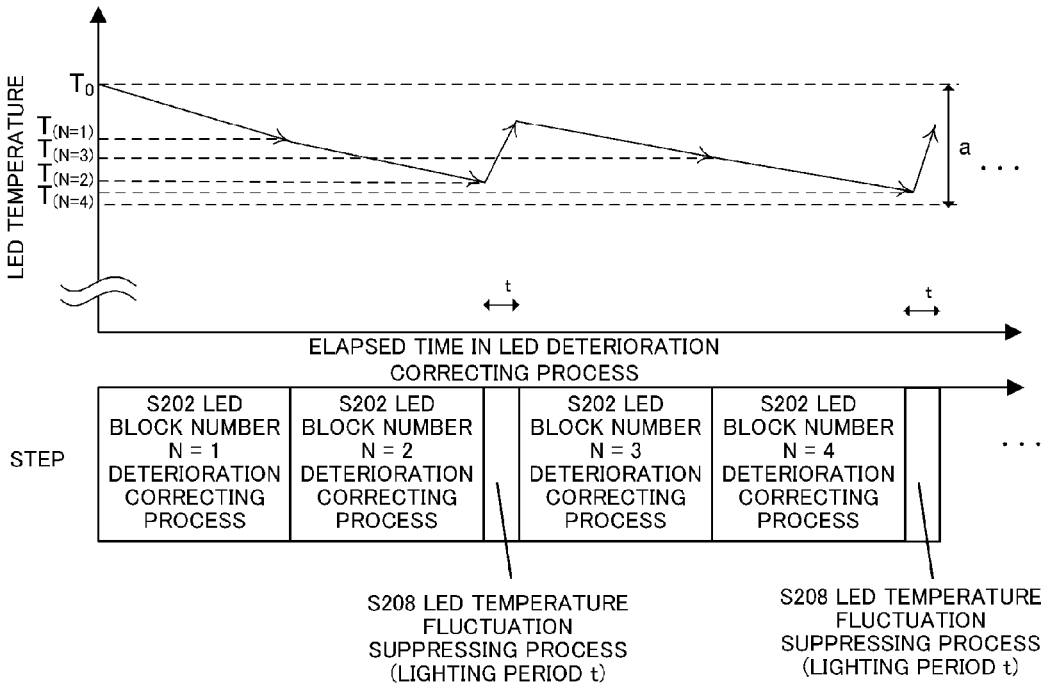

FIG. 6B shows an exemplary relationship among the elapsed time, the process step, and the LED temperature when the LED temperature fluctuation suppressing process is inserted every time when the LED deterioration correcting process is executed for the two LED blocks. As shown in FIG. 6B, if the amount of decrease in the LED temperature is small in the LED deterioration correcting process period for one LED block, the LED deterioration correcting process can be also carried out continuously for the two or more LED blocks.

In Step S205 in the flow chart shown in FIG. 5, the lighting period t is prolonged. However, the light emission luminance may be raised for the LED block subjected to the light emission in the LED temperature fluctuation suppressing process in place thereof or in combination therewith. Accordingly, it is also possible to raise the LED temperature. In Step S207, the lighting time t is shortened. However, the light emission luminance may be lowered for the LED block subjected to the light emission in the LED temperature fluctuation suppressing process in place thereof or in combination therewith. Accordingly, it is also possible to lower the LED temperature.

Second Embodiment

In the first embodiment, the explanation has been made about the exemplary case in which all of the LED blocks 202 are turned ON at the same time in the LED temperature fluctuation suppressing process to be inserted into the LED deterioration correcting process period. In the second embodiment, an explanation will be made about an exemplary case in which the lighting of any unnecessary LED block is suppressed in the LED temperature fluctuation suppressing process in order to reduce the electric power consumption in the LED temperature fluctuation suppressing process.

A description will be made below about an exemplary sequence of the LED blocks 106 subjected to the LED deterioration correcting process and exemplary LED block or blocks 106 unnecessary to be turned ON in the LED temperature fluctuation suppressing process executed after the LED deterioration correcting process for each of the LED blocks 106. It is noted that the points or features are the same as those of the first embodiment unless otherwise specifically stated.

Figure 7:
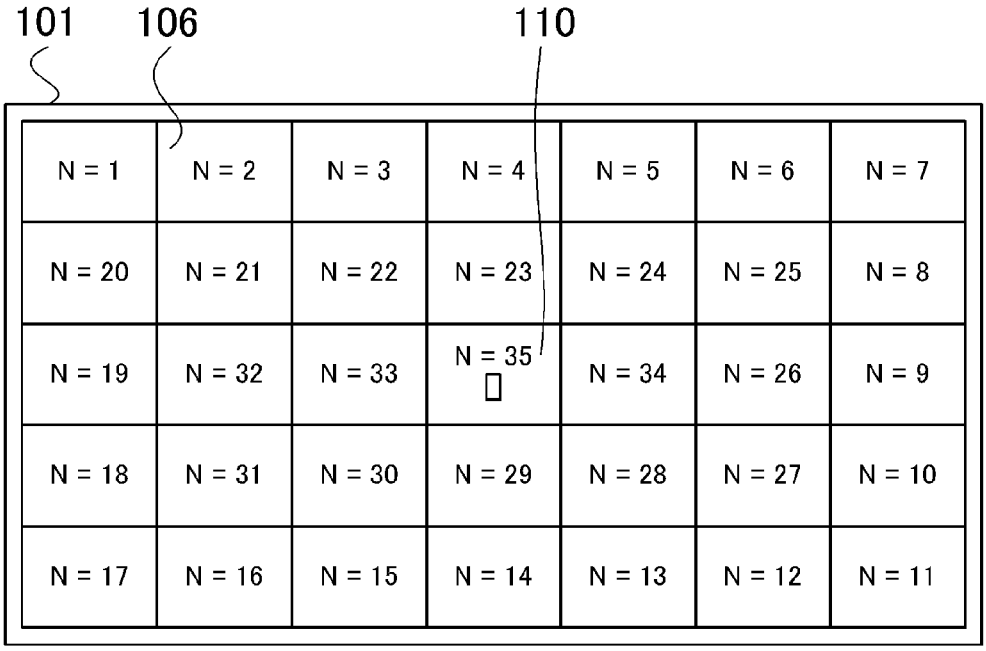
FIG. 7 schematically shows exemplary allotment of LED block numbers.

FIG. 7 schematically shows the allotment of LED block numbers N=n provided when the direct type LED backlight module 101 is divided into thirty-five LED blocks 106 in total wherein five LED blocks 106 are provided in the vertical direction and seven LED blocks 106 are provided in the lateral direction. As shown in FIG. 7, the LED block numbers N=n are allotted from the LED block disposed on the most outer circumferential side of the direct type LED backlight module 101 toward the LED blocks positioned on the inner side (central side). The microcomputer 210 performs the LED deterioration correcting process in the order of the LED block numbers N=n in the same manner as in the first embodiment. The LED block number N=35 is allotted to the LED block 110 on which the temperature sensor is mounted, for which the LED deterioration correcting process is performed at last.

In this embodiment, it is assumed that the temperature of the LED block not adjacent to any LED block for which the LED deterioration correcting process is unexecuted does not affect the temperature fluctuation of the LED block for which the LED deterioration correcting process is unexecuted. Accordingly, it is allowed that the temperature of the LED block not adjacent to any LED block for which the LED deterioration correcting process is unexecuted is lowered by not less than the threshold value a from the initial temperature $T_0$. Therefore, the LED block, which is not adjacent to any LED block for which the LED deterioration correcting process is unexecuted at a certain point in time, is not turned ON in the LED temperature fluctuation suppressing process to be performed after the point in time. In other words, only the LED block for which the LED deterioration correcting process is unexecuted at a certain point in time and the LED block adjacent to the LED block for which the LED deterioration correcting process is unexecuted are turned ON in the LED temperature fluctuation suppressing process to be performed after the point in time. Also in this procedure, the fluctuation of the LED temperature of the LED block as the objective of the LED deterioration correcting process to be performed after the point in time can be suppressed within the threshold value as starting from the initial temperature $T_0$. Therefore, it is possible to sufficiently suppress the decrease in the accuracy of the correction caused by the LED deterioration correcting process.

In this procedure, the LED block, which shares the side or the apex with a certain LED block, is designated as the LED block adjacent to the certain LED block. The LED blocks, which are adjacent to the LED block 106 having the LED block number N=1, are the LED blocks 106 having the LED block numbers N=2, 20, 21. The LED blocks, which are adjacent to the LED block 106 having the LED block number N=22, are the LED blocks 106 having the LED block numbers N=2, 3, 4, 23, 35, 33, 32, 21.

In the LED temperature fluctuation suppressing process performed after the execution of the LED deterioration correcting process for the LED blocks 106 having the LED block numbers from N=1 to 20 respectively, all of the LED blocks 106 are turned ON, for the following reason. That is, as for the LED blocks having the LED block numbers N=n (n=1 to 20), each of the LED blocks is adjacent to any one of the LED blocks (LED block numbers N=n+1 to 35) for which the LED deterioration correcting process is unexecuted at the point in time after the execution of the LED deterioration correcting process for the concerning LED block.

Figure 8:
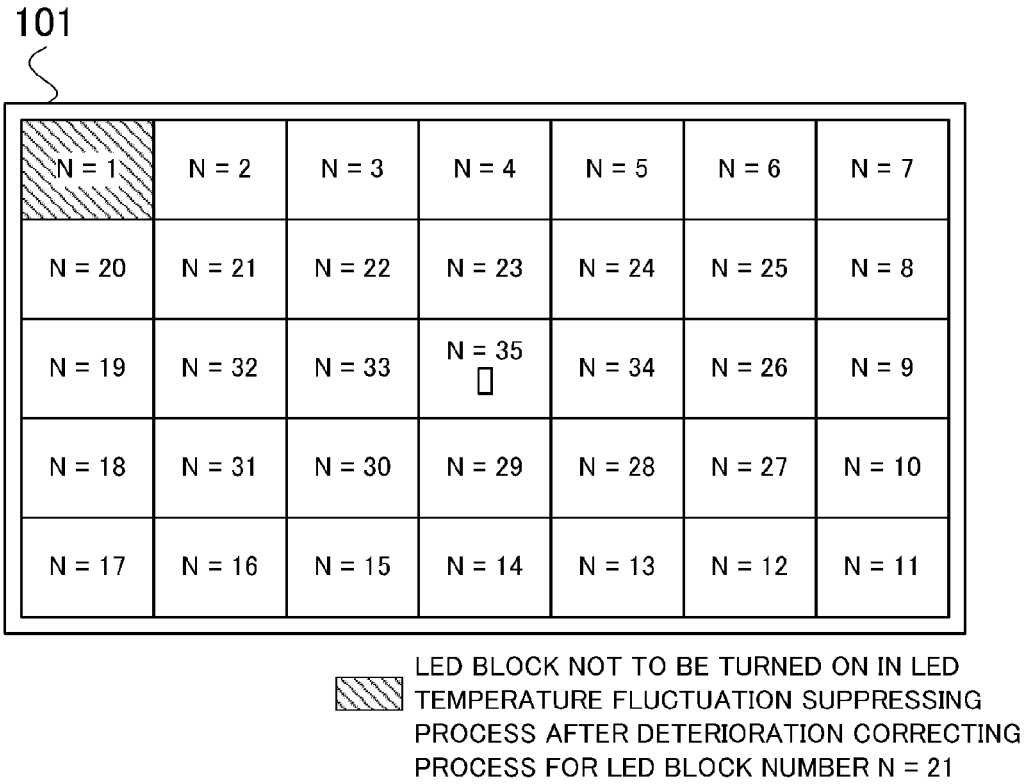
FIG. 8 shows LED blocks to be turned ON in the LED temperature fluctuation suppressing process (N=21).

FIG. 8 shows the LED blocks 106 to be turned ON and the LED block 106 not to be turned ON in the LED temperature fluctuation suppressing process executed after the LED deterioration correcting process for the LED block 106 having the LED block number N=21. As shown in FIG. 8, the LED block 106 having the LED block number N=1 is not turned ON in the LED temperature fluctuation suppressing process performed after the execution of the LED deterioration correcting process for the LED block 106 having the LED block number N=21.

The LED block having the LED block number N=1 is not adjacent to the LED blocks (LED blocks having the LED block number N=22 and followings) as the objectives of the LED deterioration correcting process after the execution of the LED deterioration correcting process for the LED block 106 having the LED block number N=21. The LED deterioration correcting process is not performed for the LED block 106 to which the LED block 106 having the LED block number N=1 is adjacent, after the execution of the LED deterioration correcting process for the LED block 106 having the LED block number N=21. Therefore, even if the temperature of the LED block 106 having the LED block number N=1 is greatly fluctuated, it is possible to suppress the decrease in the accuracy of the correction caused by the LED deterioration correcting process for the LED blocks having the LED block number N=22 and followings. When the LED block having the LED block number N=1 is not turned ON, it is possible to expect the reduction of the electric power consumption required to perform the LED temperature fluctuation suppressing process.

Similarly, the LED block 106, which is not adjacent to the LED block 106 for which the LED deterioration correcting process is to be performed thereafter, is not turned ON in the LED temperature fluctuation suppressing process. In other words, the LED block for which the LED deterioration correcting process is not executed yet and the LED block which is adjacent thereto are turned ON in the LED temperature fluctuation suppressing process.

For example, in the LED temperature fluctuation suppressing process which is executed after the LED deterioration correcting process for the LED block 106 having the LED block number N=22, the LED blocks 106 except for those having the LED block numbers N=1, 2 are turned ON, for the following reason. That is, the LED blocks 106 having the LED block numbers 1, 2 are not adjacent to any one of the LED blocks (LED block numbers N=23 to 35) for which the LED deterioration correcting process is unexecuted. Similarly, the LED blocks 106 except for those having the LED block numbers N=1 to 3 are turned ON in the LED temperature fluctuation suppressing process which is executed after the LED deterioration correcting process for the LED block 106 having the LED block number N=23.

Figure 9:
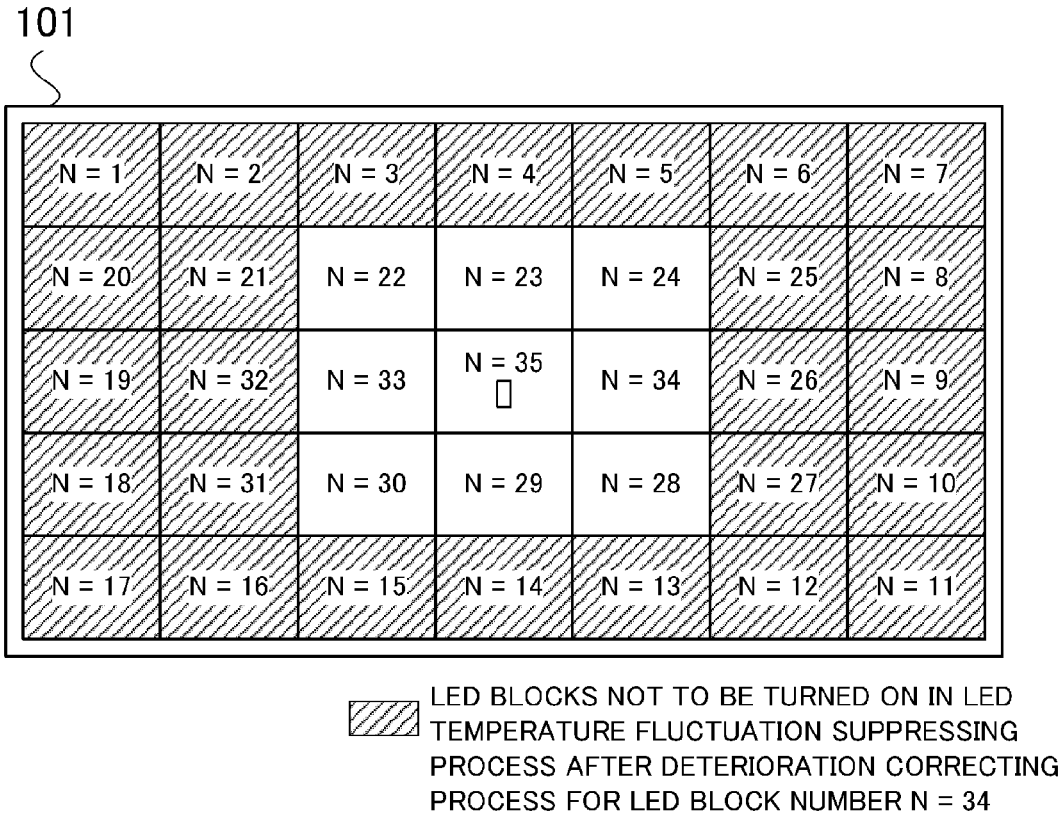
FIG. 9 shows LED blocks to be turned ON in the LED temperature fluctuation suppressing process (N=34).

FIG. 9 schematically shows the LED blocks 106 to be turned ON in the LED temperature fluctuation suppressing process executed after the LED deterioration correcting process for the LED block 106 having the LED block number N=34. In this case, the LED block, for which the LED deterioration correcting process is unexecuted, is only the LED block having the LED block number N=35. The nine LED blocks 106 in total, from which the LED blocks 106 not adjacent thereto are excluded, are turned ON.

According to this embodiment, it is possible to suppress the fluctuation of the LED temperature during the LED deterioration correcting process period while suppressing the electric power consumption relevant to the LED temperature fluctuation suppressing process. It is possible to suppress the decrease in the accuracy of the LED deterioration correcting process resulting from the temperature dependency of the light emission efficiency of LED.

This embodiment is illustrative of the exemplary case wherein the LED block, which is not adjacent to any one of the LED blocks for which the LED deterioration correcting process is unexecuted at a certain point in time, is not turned ON in the LED temperature fluctuation suppressing process to be performed after the point in time. However, there is no limitation thereto. It is also allowable that the LED block, for which the LED deterioration correcting process has been executed at a certain point in time, is not turned ON in the LED temperature fluctuation suppressing process to be performed after the point in time. In other words, it is also allowable that only the LED block, for which the LED deterioration correcting process is unexecuted at a certain point in time, is turned ON in the LED temperature fluctuation suppressing process to be performed after the point in time. In this case, for example, in the LED temperature fluctuation suppressing process executed after the LED deterioration correcting process for the LED block 106 having the LED block number N=21, the LED blocks 106 having the LED block numbers N=1 to 21 are not turned ON, and the LED blocks 106 having the LED block numbers N=22 to 35 are turned ON. Further, in the LED temperature fluctuation suppressing process executed after the LED deterioration correcting process for the LED block 106 having the LED block number N=34, the LED blocks 106 having the LED block numbers N=1 to 34 are not turned ON, and only the LED block 106 having the LED block number N=35 is turned ON.

Third Embodiment

In the first embodiment, the explanation has been made for the exemplary case in which the LED temperature fluctuation suppressing process is executed every time when the LED deterioration correcting process is performed for one of the LED blocks or a plurality of the LED blocks. In other words, the LED temperature fluctuation suppressing process is inserted every time when the LED deterioration correcting process is performed for a predetermined number of LED block or blocks.

On the other hand, in this embodiment, it is judged whether or not the LED temperature is lowered by not less than a threshold value from the LED temperature provided when the LED deterioration correcting process is started, every time when the LED deterioration correcting process is performed for one of the LED blocks or a plurality of the LED blocks. It is judged whether or not the execution of the LED temperature fluctuation suppressing process is required depending on the judgment result. In other words, if the LED temperature is not lowered by not less than the threshold value as compared with the LED temperature upon the start of the LED deterioration correcting process, the LED temperature fluctuation suppressing process is not executed. Therefore, the execution interval of the LED temperature fluctuation suppressing process is not constant.

Figure 10:
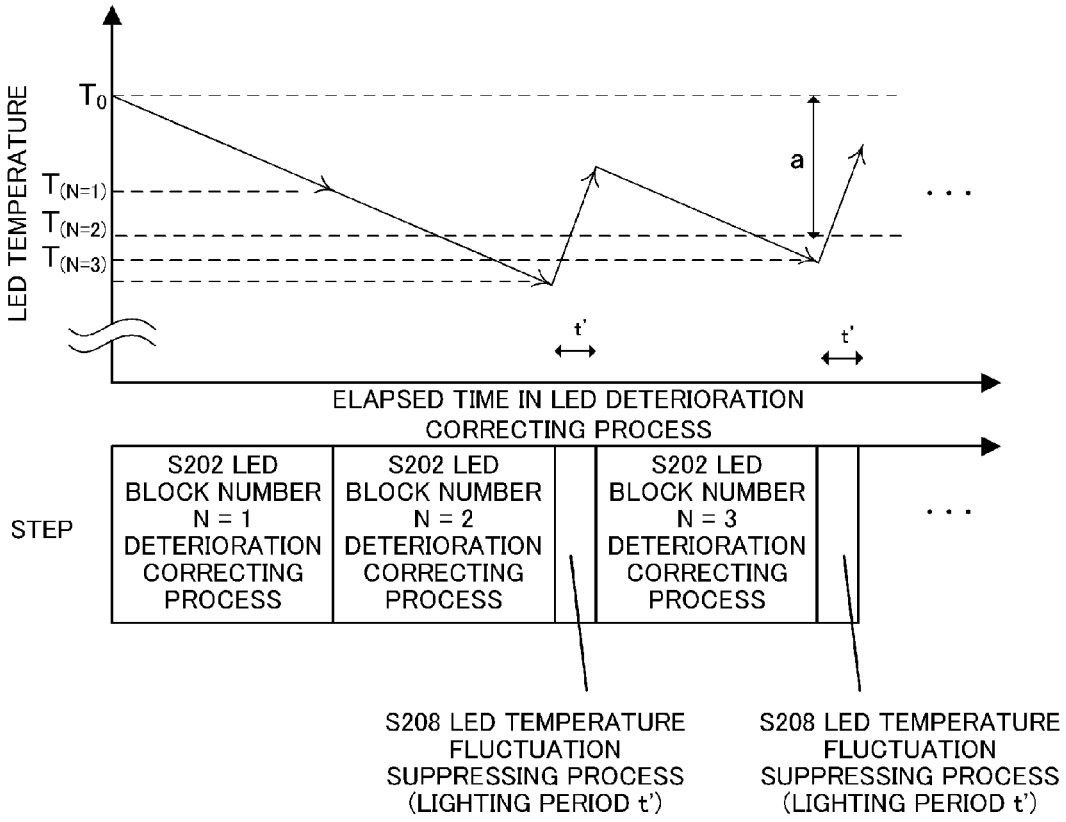
FIG. 10 shows an exemplary relationship among the elapsed time in the LED deterioration correcting process, the step, and the LED temperature.

FIG. 10 shows a relationship among the elapsed time, the LED temperature, and the process step when the LED deterioration correcting process of this embodiment is executed. As shown in FIG. 10, the LED temperature $T_{(N=1)}$ which is obtained after the execution of the LED deterioration correcting process for the LED block number N=1, is not lower by not less than the threshold value a than the LED temperature $T_0$ upon the start of the LED deterioration correcting process. Therefore, the microcomputer 210 allows the routine to proceed to the LED deterioration correcting process for the LED block having the next LED block number N=2 without executing the LED temperature fluctuation suppressing process (routine proceeds to Step S210 and Step S202 while skipping the process of Step S208).

The LED temperature $T_{(N=2)}$, which is obtained after the execution of the LED deterioration correcting process for the LED block number N=2, is lower by not less than the threshold value a than the LED temperature $T_0$ upon the start of the LED deterioration correcting process. Therefore, the microcomputer 210 allows the routine to proceed to the LED deterioration correcting process for the next LED block number N=3 after executing the LED temperature fluctuation suppressing process. Further, the LED temperature $T_{(N=3)}$, which is obtained after the execution of the LED deterioration correcting process for the LED block number N=3, is lower by not less than the threshold value a than the LED temperature $T_0$ upon the start of the LED deterioration correcting process. Therefore, the microcomputer 210 allows the routine to proceed to the LED deterioration correcting process for the next LED block number N=4 after executing the LED temperature fluctuation suppressing process.

As described above, it is judged whether or not the execution is required for the LED temperature fluctuation suppressing process every time when the LED deterioration correcting process is executed for the LED block. Accordingly, it is possible to suppress the execution of any unnecessary LED temperature fluctuation suppressing process. It is possible to suppress the electric power consumption resulting from the execution of the LED temperature fluctuation suppressing process.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-024895, filed on Feb. 8, 2011, and Japanese Patent Application No. 2011-272655, filed on Dec. 13, 2011, which are hereby incorporated by reference herein in their entirety.

What is claimed is:

1. A backlight apparatus having a plurality of light source blocks, the backlight apparatus comprising:

a luminance detecting unit which detects a luminance of the light source blocks;

a control unit which successively executes a detecting process for each of the plurality of light source blocks by controlling the plurality of light source blocks to turn on one by one, and determines a correction amount of each light source block on the basis of a luminance value detected by the luminance detecting unit and a target value thereof; and a temperature fluctuation suppressing unit which executes a temperature fluctuation suppressing process after the control unit executed the detecting process for a light source block as a detecting objective, and before the control unit executes the detecting process for another light source block as next detecting objective during the entire process of executing detecting processes for all of the light source blocks of the backlight apparatus, wherein, in the temperature fluctuation suppressing process, the temperature fluctuation suppressing unit controls at least one of the plurality of light source blocks to turn on for a predetermined period so that the light source block as the next detecting objective is heated, the at least one of the plurality of light source blocks including the light source block as the next detecting objective.

2. The backlight apparatus according to claim 1, wherein the target value is determined for each of the light source blocks so that a luminance dispersion among the plurality of light source blocks is not more than an allowable level.

3. The backlight apparatus according to claim 1, wherein the temperature fluctuation suppressing unit controls all of the light source blocks to turn on in the temperature fluctuation suppressing process.

4. The backlight apparatus according to claim 1, wherein the temperature fluctuation suppressing unit controls the light source block or blocks for which the detecting process is/are unexecuted and the light source block or blocks which is/are adjacent thereto to turn on for a predetermined period in the temperature fluctuation suppressing process.

5. The backlight apparatus according to claim 1, further comprising:

a temperature detecting unit which detects a temperature of the light source block, wherein:

the temperature fluctuation suppressing unit detects the temperature of the light source block by means of the temperature detecting unit every time before the control unit executes the detecting process for the light source block as the detecting objective, and the predetermined period is prolonged if the detected temperature is lower by not less than a threshold value than an initial temperature detected by the temperature detecting unit after the control unit executes the detecting process for an initial light source block.

6. The backlight apparatus according to claim 5, wherein the temperature fluctuation suppressing unit detects the temperature of the light source block by means of the temperature detecting unit every time before the control unit executes the detecting process for the light source block as the detecting objective, and the predetermined period is shortened if the detected temperature is higher than the initial temperature by not less than a threshold value.

7. The backlight apparatus according to claim 5, wherein the temperature detecting unit detects the temperature of the light source block positioned at a center of the plurality of light source blocks.

8. The backlight apparatus according to claim 5, wherein:

the temperature detecting unit includes a temperature sensor which is provided for each group of a plurality of the light source blocks; and the temperature fluctuation suppressing unit detects the temperature of the light source block by means of the temperature sensor corresponding to the group to which the light source block, subjected to the detecting process executed just before, belongs.

9. The backlight apparatus according to claim 1, further comprising:

a temperature detecting unit which detects a temperature of the light source block, wherein:

the temperature fluctuation suppressing unit detects the temperature of the light source block by means of the temperature detecting unit every time before the control unit executes the detecting process for the light source block as the detecting objective, and luminance emitted by the at least one of the plurality of light source blocks in the temperature fluctuation suppressing process is raised if the detected temperature is lower by not less than a threshold value than an initial temperature detected by the temperature detecting unit after the control unit executes the detecting process for an initial light source block.

10. The backlight apparatus according to claim 9, wherein the temperature fluctuation suppressing unit detects the temperature of the light source block by means of the temperature detecting unit every time before the control unit executes the detecting process for the light source block as the detecting objective, and luminance emitted by the at least one of the plurality of light source blocks in the temperature fluctuation suppressing process is lowered if the detected temperature is higher than the initial temperature by not less than a threshold value.

11. The backlight apparatus according to claim 1, further comprising:

a temperature detecting unit which detects a temperature of the light source block, wherein:

the temperature fluctuation suppressing unit detects the temperature of the light source block by means of the temperature detecting unit every time before the control unit executes the detecting process for the light source block as the detecting objective, and the temperature fluctuation suppressing process is executed if the detected temperature is lower by not less than a threshold value than an initial temperature detected by the temperature detecting unit after the control unit executes the detecting process for an initial light source block.

12. The backlight apparatus according to claim 1, wherein:

the luminance detecting unit includes an optical sensor which is provided for each group of a plurality of the light source blocks; and the target value of the luminance value of the light source block detected by the luminance detecting unit, which is used by the control unit, is determined depending on a positional relationship between the light source block as the detecting objective and the optical sensor corresponding to the group to which the light source block as the detecting objective belongs.

13. The backlight apparatus according to claim 1, wherein the control unit starts the execution of the detecting process from the light source block positioned on a most outer circumferential side of the plurality of light source blocks, and the detecting process is successively executed for the light source block positioned on a more inner circumferential side.

14. An image display apparatus comprising the backlight apparatus as defined in claim 1 and a liquid crystal panel.

15. A control method for controlling a backlight apparatus having a plurality of light source blocks, the control method comprising:

a luminance detecting step of detecting a luminance of the light source blocks;

a control step of successively executing a detecting process for each of the plurality of light source blocks by controlling the plurality of light source blocks to turn on one by one and determining a correction amount of each light source block on the basis of a luminance value detected in the luminance detecting step and a target value thereof; and a temperature fluctuation suppressing step of executing a temperature fluctuation suppressing process after the detecting process for a light source block as a detecting objective was executed in the control step, and before the detecting process is executed in the control step for another light source block as next detecting objective during the entire process of executing detecting processes for all of the light source blocks of the backlight apparatus, wherein, in the temperature fluctuation suppressing process, at least one of the plurality of light source blocks is controlled to turn on for a predetermined period so that the light source block as the next detecting objective is heated, the at least one of the plurality of light source blocks including the light source block as the next detecting objective.

16. The control method for controlling a backlight apparatus according to claim 15, wherein the target value is determined for each of the light source blocks so that a luminance dispersion among the plurality of light source blocks is not more than an allowable level.

17. The control method for controlling a backlight apparatus according to claim 15, wherein, in the temperature fluctuation suppressing step, all of the light source blocks are controlled to turn on in the temperature fluctuation suppressing process.

18. The control method for controlling a backlight apparatus according to claim 15, wherein, in the temperature fluctuation suppressing step, the light source block or blocks for which the detecting process is/are unexecuted and the light source block or blocks which is/are adjacent thereto are controlled to turn on for a predetermined period in the temperature fluctuation suppressing process.

19. The control method for controlling a backlight apparatus according to claim 15, further comprising:

a temperature detecting step of detecting a temperature of the light source block, wherein, in the temperature fluctuation suppressing step, the temperature of the lightsource block is detected in the temperature detecting step every time before the detecting process for the light source block as the detecting objective is executed in the control step, and the predetermined period is prolonged if the detected temperature is lower by not less than a threshold value than an initial temperature detected in the temperature detecting step after the detecting process for an initial light source block is executed in the control step.

20. The control method for controlling a backlight apparatus according to claim 19, wherein, in the temperature fluctuation suppressing step, the temperature of the light source block is detected in the temperature detecting step every time before the detecting process for the light source block as the detecting objective is executed in the control step, and the predetermined period is shortened if the detected temperature is higher than the initial temperature by not less than a threshold value.

21. The control method for controlling a backlight apparatus according to claim 19, wherein, in the temperature detecting step, the temperature of the light source block positioned at a center of the plurality of light source blocks is detected.

22. The control method for controlling a backlight apparatus according to claim 19, wherein:

in the temperature detecting step, the temperature of the light source block is detected by means of a temperature sensor which is provided for each group of a plurality of the light source blocks; and in the temperature fluctuation suppressing step, the temperature of the light source block is detected by means of the temperature sensor corresponding to the group to which the light source block, subjected to the detecting process executed just before, belongs.

23. The control method for controlling a backlight apparatus according to claim 15, further comprising:

a temperature detecting step of detecting a temperature of the light source block, wherein, in the temperature fluctuation suppressing step, the temperature of the light source block is detected in the temperature detecting step every time before the detecting process for the light source block as the detecting objective is executed in the control step, and luminance emitted by the at least one of the plurality of light source blocks in the temperature fluctuation suppressing process is raised if the detected temperature is lower by not less than a threshold value than an initial temperature detected in the temperature detecting step after the detecting process for an initial light source block is executed in the control step.

24. The control method for controlling a backlight apparatus according to claim 23, wherein, in the temperature fluctuation suppressing step, the temperature of the light source block is detected in the temperature detecting step every time before the detecting process for the light source block as the detecting objective is executed in the control step, and luminance emitted by the at least one of the plurality of light source blocks in the temperature fluctuation suppressing process is lowered if the detected temperature is higher than the initial temperature by not less than a threshold value.

25. The control method for controlling a backlight apparatus according to claim 15, further comprising:

a temperature detecting step of detecting a temperature of the light source block, wherein, in the temperature fluctuation suppressing step, the temperature of the light source block is detected in the temperature detecting step every time before the detecting process for the light source block as the detecting objective is executed in the control step, and the temperature fluctuation suppressing process is executed if the detected temperature is lower by not less than a threshold value than an initial temperature detected in the temperature detecting step after the detecting process for an initial light source block is executed in the control step.

26. The control method for controlling a backlight apparatus according to claim 15, wherein:

in the luminance detecting step, the luminance of the light source blocks is detected by means of an optical sensor which is provided for each group of a plurality of the light source blocks; and the target value of the luminance value of the light source block detected in the luminance detecting step, which is used in the control step, is determined depending on a positional relationship between the light source block as the detecting objective and the optical sensor corresponding to the group to which the light source block as the detecting objective belongs.

27. The control method for controlling a backlight apparatus according to claim 15, wherein, in the control step, the execution of the detecting process is started from the light source block positioned on a most outer circumferential side of the plurality of light source blocks, and the detecting process is successively executed for the light source block positioned on a more inner circumferential side.

28. A backlight apparatus having a plurality of light source blocks, the backlight apparatus comprising:

a luminance detecting unit which successively executes a detecting process for detecting a luminance of each of the plurality of light source blocks by controlling the plurality of light source blocks to turn on one by one; and a control unit which executes a temperature controlling process after the luminance detecting unit executed the detecting process for a light source block as a detecting objective, and before the luminance detecting unit executes the detecting process for another light source block as next detecting objective during the entire process of executing detecting processes for all of the light source blocks of the backlight apparatus, wherein, in the temperature controlling process, the control unit controls at least one of the plurality of light source blocks which include the light source block as the next detecting objective to turn on so that the light source block as the next detecting objective is heated.

29. A control method for controlling a backlight apparatus having a plurality of light source blocks, the control method comprising:

a luminance detecting step of executing a detecting process for detecting a luminance of each of the plurality of light source blocks by controlling the plurality of light source blocks to turn on one by one; and a control step of executing a temperature controlling process after the detecting process for a light source block as a detecting objective in the luminance detecting step, and before the detecting process for another light source block as next detecting objective is executed in the luminance detecting step, during the entire process of executing detecting processes for all of the light source blocks of the backlight apparatus, wherein, in the temperature controlling process, at least one of the plurality of light source blocks which include the light source block as the next detecting objective is controlled to turn on so that the light source block as next the detecting objective is heated.

* * * * *